US005232827A

United States Patent [19]

Lok et al.

[11] Patent Number: 5,232,827

[45] Date of Patent: Aug. 3, 1993

[54] STABILIZED PHOTOGRAPHIC RECORDING MATERIALS

[75] Inventors: Roger Lok; Arthur H. Herz, both of Rochester, N.Y.

[73] Assignee: Eastman Kodak Company, Rochester, N.Y.

[21] Appl. No.: 756,725

[22] Filed: Sep. 9, 1991

[51] Int. Cl.[5] ..... G03C 1/34

[52] U.S. Cl. ..... 430/607; 430/600; 430/608; 430/611; 430/551

[58] Field of Search ..... 430/607, 600, 608, 611, 430/528, 529, 551

[56] References Cited

U.S. PATENT DOCUMENTS

| | | | |
|---|---|---|---|
| 3,185,569 | 5/1965 | Weber . | |
| 3,232,761 | 2/1966 | Allen et al. . | |
| 3,255,000 | 6/1966 | Gates, Jr. et al. . | |
| 3,301,677 | 1/1967 | Konig et al. . | |
| 3,312,550 | 4/1967 | Stewart et al. . | |
| 3,396,028 | 8/1968 | Humphlett . | |
| 3,486,901 | 12/1969 | Karlson | 480/607 |
| 3,598,601 | 8/1971 | Beavers . | |
| 3,635,717 | 1/1972 | Ohi et al. . | |
| 3,645,743 | 2/1972 | Mucke et al. . | |
| 3,733,196 | 5/1973 | Abel et al. . | |
| 3,769,017 | 10/1973 | Sakamoto et al. . | |
| 3,861,924 | 1/1975 | Mackey et al. . | |
| 3,936,300 | 2/1976 | Cardone . | |
| 4,161,407 | 7/1979 | Campbell . | |

FOREIGN PATENT DOCUMENTS

| | | |
|---|---|---|
| 40-376 | 1/1965 | Japan . |
| 57-040244 | 3/1982 | Japan . |

*Primary Examiner*—Charles L. Bowers, Jr.
*Assistant Examiner*—Thorl Chea
*Attorney, Agent, or Firm*—Paul A. Leipold

[57] ABSTRACT

Stabilized photographic recording materials are described which comprise ammonium salts of inorganic acids or of organic acids and preferably those that contain polyhydroxyalkyl residues. Use of these stabilizing compounds in combination with recognized antifogging agents provides enhanced storage stability of coated photographic compositions.

14 Claims, No Drawings

STABILIZED PHOTOGRAPHIC RECORDING MATERIALS

TECHNICAL FIELD

This invention relates to stabilized photographic recording materials. More particularly, this invention relates to stabilization of photographic silver halide recording materials using ammonium salts of inorganic acids or organic acids which can be employed advantageously in combination with art-recognized antifogging or co-stabilizing agents.

BACKGROUND ART

Heretofore, both ammonia and ammonium salts have found varied use in the formation, sensitization, and coating preparation of photographic emulsions. For example, ammonium bromide has been used as the halide ion source at approximately equal molar concentrations to that of the soluble silver salt in the formation of photographic emulsions. Low levels of ammonium salts have been employed for modifying the size of silver halide crystals. For example, ammonium thiocyanate has been used as a silver ion ligand and Ostwald ripener. Similarly, low levels of ammonium salts, such as ammonium thiosulfate or ammonium chloroiridite and analogous noble metal complexes which are components of a redox couple, have found use in modifying the sensitivity or sensitometric response of silver halide emulsions. Furthermore, the literature discusses the use of high concentrations of ammonium salts and of amines in combination with certain synthetic polymers or cross-linking agents that were added to silver halide gelatin emulsions to control the viscosity or hardness of the photographic composition. While it is apparent from U.S. Pat. Nos. 3,232,761; 3,645,743; 3,861,924; and 4,161,407 that amines and ammonium salts in such combinations enhance desirable physical characteristics of emulsions, it is also known, for example, from U.S. Pat. No. 3,255,000, such amines diminish the contrast of photographic emulsions and, more importantly, enhance emulsion fog. Clearly, it has been recognized that ammonia, ammonium salts, and amines can effect both the physical and sensitometric characteristics of photographic silver halide emulsions.

The foregoing applications involve modifications in the preparation of silver halide materials, their sensitivity or their physical properties. There remains a need for compounds capable of stabilizing coated silver halide emulsions during their storage against changes of sensitivity and the formation of fog. The stabilized compounds needed are neither components of a redox couple which can reduce silver ions or oxidize elemental silver, nor are they effective silver ion ligands It is an undesirable property of such ligands that they substantially alter the silver potential of emulsions, even if such emulsions contain excess soluble halide ions such as 0.002M KBr.

DISCLOSURE OF INVENTION

The ammonium salts of this invention are salts of inorganic and organic acids which have the following formula:

$A^-NH(R)_3^+$ wherein:

A is the deprotonated anionic moiety of an inorganic or an organic acid. Typical examples of such acids include nitric, sulfuric, fluoroboric, benzoic, toluenesulfonic, toluenethiosulfonic, gluconic, malonic acids, and the like. When A is the anionic moiety of an organic acid, it is preferred that the molecular weight be above 50 and preferably greater than 100.

R in the cationic nitrogen-containing moiety, is hydrogen or an alkyl group having from 1 to 3 carbon atoms, with the proviso that the total number of carbon atoms represented by the R groups is not greater than 6. Typical examples of the cationic nitrogen-containing moieties useful in this invention include: $NH_4^+$ $NH_3CH_3^+$, $NH_3C_2H_5^+$, $NH_3CH_2CH_2OH^+$, $NH_3(CH_2CH_2CH_3)^+$, $NH_2(CH_3)_2^+$, $NH(CH_3)_3^+$, $NH(C_2H_5)_3^+$.

MODES FOR CARRYING OUT THE INVENTION

Accordingly, the present invention provides for the stabilization of silver halide emulsions by ammonium salts of inorganic or organic acids which are generally added after sensitization but prior to its coating on a support. This stabilization of emulsions by the ammonium salts of this invention can be further enhanced by using these compounds in combination with a recognized antifogging and stabilizing agent which itself is capable of promoting the stability of a photographic recording material. Thus, hereinafter, reference to "costabilizing" or "antifogging" agents will also include art-recognized compounds like those discussed by E. J. Birr in "Stabilization of Photographic Silver Halide Emulsions", Focal Press, London, 1974.

Many compounds of this invention are commercially available; in general, they are prepared by neutralization of an acid with ammonia on an amine base. Examples of ammonium salt preparations can be found in The Merck Index.

The art-recognized antifoggants and stabilizers which can be combined with the ammonium salts of inorganic or organic acids of the invention include the cyclic sulfur, selenium or tellurium compounds of U.S. Pat. Nos. 2,131,038; 3,954,478; 4,661,438; 4,677,202, as well as their derivatives which are described in U.S. Pat. Nos. 4,374,196; 4,423,140, and the compounds based on selena ureas or thioureas of U.S. Pat. Nos. 3,220,839; 3,598,598, and 3,811,896. The co-stabilizers which can be used advantageously in combination with the ammonium salts of this invention also include selenols, thiols, and their oxidation products as discussed in U.S. Pat. Nos. 1,962,133; 2,948,614; 3,043,696; 3,057,725; 3,062,654; 3,732,103 (Reissued as Re. 28,660) or the polyhydroxyalkyl compounds of U.S. Pat. No. 3,396,028 and the copending U.S. patent application Ser. No. 493,598 filed Mar. 5, 1990, by Lok and Herz, entitled "Stabilization of Photographic Recording Materials" as well as the azoles, purines, and azaindenes which are detailed in the previously cited monograph by E. J. Birr.

Particularly useful co-stabilizers for the ammonium salts of this invention are the acidic compounds RSH, RSeH, and RNH, where R represents an acyclic, cyclic, or heterocyclic residue. These sulfur acids, selenium acids, and nitrogen acids may involve tautomeric forms where the hydrogen atom is attached to a different oxygen, sulfur, or selenium atom. Alternatively, the proton H of these compounds may be replaced by an organic or inorganic cation, such as a potassium or tetramethylammonium ion. Examples of such co-stabilizing acids or their salts are shown below:

1. mercaptoacetic acid
2. o-mercaptobenzoic acid
3. p-toluenethiosulfonic acid, potassium salt
4. o-mercapto-N-methyl-N-formylaniline
5. 5-mercapto-1-phenyltetrazole
6. 1-(3-acetamidophenyl)-5-mercaptotetrazole
7. 2-hydroselenol-N-ethyl-acetanilide
8. 5-chloro-benzotriazole
9. 5-(4-cyanophenyl)-tetrazole
10. 4-hydroxy-6-methyl-1,3,3A,7-tetraazaindene, sodium salt
11. 5-nitroindazole
12. 4-hydroxy-6-methyl-2-methylthio-1,3,3A,7-tetraazaindene
13. tolylthiosulfonic acid sodium salt The concentration of the ammonium salts of this invention can vary over a wide range; the desired emulsion stabilization can be provided by about 1 to about 1000 mmoles of ammonium salt per mole of silver halide. Satisfactory results are generally obtained at the preferred concentrations from about 50 to 250 mmoles ammonium salt per mole of silver halide.

The concentration of the co-stabilizing agent can also vary widely and may range from about 0.05 to about 200 mmoles per mole of silver halide with preferred concentrations ranging from about 0.15 to about 50 mmoles per mole of silver halide.

The ammonium salts of this invention and the optional co-stabilizing agent can be admixed with the final emulsion composition prior to coating. Since such compounds are water soluble, they can be added to the silver halide layer itself or to any other permeable layer of the photographic recording material. Any known technique for adding a soluble compound to a coating composition can be employed. The ammonium salt compound can be incorporated either in a silver halide layer or in a layer associated therewith.

The term "associated therewith", as used herein, is intended to mean that the compound or compounds can be in either the same or different layers so long as the compounds are accessible to one another.

The type of silver halides to which this invention can be applied includes silver chloride, silver bromide, silver bromoiodide, silver chlorobromide, silver chloroiodide, silver chlorobromoiodide and mixtures thereof. The silver halide crystals can be coarse, medium or fine grains or mixtures thereof. The grains may be of different morphologies, e.g., spherical, cubic, cubooctrahedral, tabular etc., or mixtures thereto. Grain size distribution may be monodisperse or polydisperse or mixtures thereof. This invention has been found to be particularly useful with silver chloride emulsions.

The silver halide emulsions useful in this invention, both negative-working and direct-positive types, are well known to those skilled in the art and are described in Research Disclosure, Volume 176, Dec. 1978, Item 17643, pages 22 and 23, entitled "Emulsion preparation and types", the disclosure of which is hereby incorporated herein by reference. The emulsions are usually chemically and spectrally sensitized emulsion layers. Either conventional negative-working or direct-positive silver halide emulsions are employed. If the silver halide emulsion employed is a direct-positive silver halide emulsion, such as an internal image emulsion or a fogged, direct-positive emulsion, such as a solarizing emulsion which is developable in unexposed areas, a positive image can be obtained on the dye image-receiving layer by using negative working ballasted, redox dye-releasers.

Internal image silver halide emulsions useful in this invention are described more fully in the Nov., 1976 edition of Research Disclosure, pages 76 through 79, the disclosure of which is hereby incorporated by reference.

The various silver halide emulsion layers of a multicolor film assembly employed in this invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

Except where noted otherwise, the silver halide emulsion layers employed in the invention comprise photosensitive silver halide dispersed in gelatin and are about 0.006 to 6 microns in thickness. The dye image-providing materials are dispersed in an aqueous alkaline solution-permeable polymeric binder, such as gelatin, as a separate layer about 0.2 to 7 microns in thickness, and the alkaline solution-permeable polymeric interlayers, e.g., gelatin, are about 0.2 to 5 microns in thickness.

The silver halide emulsions can be chemically sensitized with active gelatin, as illustrated by T. H. James, The Theory of the Photographic Process, 4th Ed., Macmillan, 1977, pp. 67–76, or with sulfur, selenium, tellurium, gold, platinum, palladium, iridium, osmium, rhenium or phosphorus sensitizers or combinations of these sensitizers.

The emulsions can be coated at pAg levels from about 5 to 10 and at pH values from about 5 to 8. Advantageous sensitization is also obtained in emulsions having pAg values between about 1 and about 4.7 and pH values between about 2 and about 5, as disclosed in co-pending U.S. pat. application Ser. No. 455,250, filed Dec. 22, 1989, by Evans and Herz, and entitled "Improved Performance of Photographic Emulsions at High Silver Ion Activities", as well as illustrated by Research Disclosure, Vol. 120, Apr. 1974, Item 12008, Research Disclosure, Vol. 134, Jun. 1975, Item 13452, Sheppard et al U.S. Pat. No. 1,623,499, Matthies et al U.S. Pat. No. 1,673,522, Waller et al U.S. Pat. No. 2,399,083, Damshroder et al U.S. Pat. No. 2,642,361, McVeigh U.S. Pat. No. 3,297,447, Dunn U.S. Pat. No. 3,297,446, McBride U.K. Patent 1,315,755, Berry et al U.S. Pat, No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U. K. Patent 1,396,696, chemical sensitization being optionally conducted in the presence of thiocyanate derivatives, as described in Damschroder U.S. Pat. No. 2,642,361, thioether compounds, as disclosed in Lowe et al U.S. Pat. No. 2,521,926, Williams et al U.S. Pat. 3,021,215 and Bigelow U.S. Pat. No. 4,054,457 and azaindenes azapyridazines and azapyrimidines, as described in Dostess U.S. Pat. No. 3,411,914, Kuwabara et al U.S. Pat. No. 3,554,757, Oguchi et al U.S. Pat. No. 3,565,631 and Oftedahl U.S. Pat. No. 3,901,714. Additionally or alternatively, the emulsions can be reduction sensitized—e.g. with hydrogen, as illustrated by Janusonis U.S. Pat. No. 3,891,446 and Babcock et al, U.S. Pat. No. 3,984,249 by low pAg (e.g. less than 5) high pH (e.g., greater than 8) treatment or through the use of reducing agents, such as stannous chloride, thiourea dioxide, polyamines and amineboranes, as illustrated by Allen et al U.S. Pat. No. 2,983,609, Oftedahl et al Research Disclosure, Vol. 136, Aug. 1975, Item 13654, Lowe et al; U.S. Pat. Nos. 2,518,698 and 2,739,060, Roberts et al U.S. Pat. No. 2,743,182 and '183, Chambers et al U.S. Pat. No. 3,026,203 and Bigelow et al U.S. Pat. No. 3,361,564.

The supports for the photographic elements used in this invention can be any material, as long as it does not deleteriously affect the photographic properties of the film unit and is dimensionally stable. Typical flexible sheet materials are described on page 85 of the Nov., 1976 edition of Research Disclosure, the disclosure of which is hereby incorporated by reference.

The following examples provide data for the concept of incorporating ammonium salts of inorganic and organic compounds into coating compositions (i.e., emulsion melts) to obtain improved storage stability. However, these examples should not be considered to be a limitation on the concept of this invention.

EXAMPLE 1

A silver chloride emulsion comprising 0.65 micron cubic crystals suspended in a solution of ossein gelatin, was optimally sensitized with aurous sulfide and an oxacarbocyanine dye at pCl 3. The emulsion which also contained a coupler dispersion, was split into aliquots to which ammonium salts of the test compounds were added at a concentration of 208 mmoles per mole of silver halide. Subsequently, these emulsion samples were adjusted to pH 5.7 and coated in a single layer on a paper support at a silver coverage of 31 mg/ft$^2$ and a coupler coverage at 100 mg/ft$^2$). Samples of the dried coatings were sensitometrically exposed after 1 week storage (50% RH) at −18° C. and at 30° C. and were then conventionally processed.

The results are shown in the following tables where speeds are normalized with respect to the control which contained no added ammonium salt; the difference in fog densities obtained between the high- and the low-temperature storage condition (ΔFog) is taken as a measure of emulsion stability.

TABLE 1

| Ammonium Salt Antifoggants | | | |
|---|---|---|---|
| Ammonium Salt | Speed* | Fog* | ΔFog |
| Control (none) | 100 | 0.07 | 0.20 |
| Nitrate | 95 | 0.07 | 0.13 |
| Fluoroborate | 95 | 0.07 | 0.14 |
| Benzoate | 91 | 0.07 | 0.13 |
| Malonate | 95 | 0.07 | 0.12 |
| Gluconate | 97 | 0.06 | 0.10 |

*Data for −18° C. Storage Condition

The data shown in Table 1 make it apparent that while the ammonium salts have no substantial effect on speed, they interfere with the formation of fog under conditions of elevated humidity and temperature. The ammonium salt of the polyhydroxyalkyl compound, gluconic acid, is particularly effective as an emulsion stabilizer.

EXAMPLE 2

An emulsion identical to that of Example 1 was used with the exception that it also contained as a common emulsion component the co-stabilizer 1-(3-acetamidophenyl)-5-mercaptotetrazole at 0.38 mmoles per mole of silver halide. The dried coatings were sensitometrically exposed after 3 days' storage (50% RH) at −18° C. and at 60° C. before they were conventionally processed. As in Example 1, speeds were normalized with respect to the control which contained no ammonium salt, and the difference in fog densities between the high- and the low-temperature storage condition (ΔFog) was again taken as a measure of emulsion stability.

TABLE 2

| Ammonium Salt Antifoggants in the Presence of a Co-Stabilizer | | | |
|---|---|---|---|
| Ammonium Salt | Speed* | Fog* | ΔFog |
| Control (none) | 100 | 0.04 | 0.40 |
| Nitrate | 94 | 0.04 | 0.27 |
| Fluoroborate | 95 | 0.04 | 0.26 |
| Benzoate | 94 | 0.04 | 0.33 |
| Malonate | 95 | 0.03 | 0.20 |
| Gluconate | 89 | 0.03 | 0.15 |

*Data for −18° C. Storage Condition

The results of Table 2 demonstrate that even in the presence of a conventional thiol antifoggant, the ammonium salts of this invention strongly enhance the stability of emulsions against fog formation at elevated temperature and humidity.

EXAMPLE 3

An emulsion identical to that of Example 1 was used with the exception that the emulsion contained a common emulsion stabilizer 4-hydroxy-6-methyl-1,3,3A,7-tetraazaindene, sodium salt (TAI) at 20 mmoles per mole or silver halide. The dried coatings were sensitometrically exposed after a 7-day storage (50% RH) at −18° C. and at 37.8° C. before they were conventionally processed. As in Example 1, speeds were normalized with respect to the control which contained no ammonium salt, and the difference in fog densities between the high- and the low-temperature storage condition (ΔFog) was again taken as a measure of emulsion stability.

TABLE 3

| Ammonium Salt Antifoggants in the Presence of a Co-Stabilizer | | | |
|---|---|---|---|
| Ammonium Salt | Speed* | Fog* | ΔFog |
| Control (none) | 100 | 0.11 | 0.18 |
| Nitrate | 095 | 0.10 | 0.09 |
| Fluoroborate | 100 | 0.11 | 0.13 |

*Data for −18° C. Storage Condition

The results of Table 3 demonstrate that even in the presence of a conventional nitrogen acid antifoggant, th ammonium salts of this invention strongly enhance the stability of emulsions against fog formation at elevated temperature and humidity.

The invention has been described in detail with particular reference to preferred embodiments thereof, but it will be understood that variations and modifications can be effected within the spirit and scope of the invention.

We claim:

1. A photographic recording material comprising a support and a photographic silver halide emulsion layer containing a coupler dispersion and which has in association with said emulsion layer an ammonium salt of an organic or inorganic acid in an amount of between about 1 and about 1000 mmoles per mole of silver halide and wherein said ammonium salt has the structure $$A^{-}NH(R)_3^{+}$$

wherein A is the anionic moiety of an inorganic or an organic acid, when A is an anionic moiety of an organic acid, the molecular weight of said anionic moiety A is above about 50 and R is hydrogen or an alkyl group having from 1 to 3 carbon atoms with the proviso that the total number of carbon atoms represented by R groups is not greater than 6.

2. The recording material according to claim 1 wherein A represents nitric, sulfuric, fluoroboric, benzoic, malonic, or gluconic acid.

3. The recording material according to claim 1 wherein A represents an organic anion containing a polyhydroxyalkyl group and R represents hydrogen.

4. A recording material according to claim 1 wherein the ammonium salt compound is present in an amount of from about 50 to about 250 mmoles per mole of silver halide.

5. A recording material according to claim 1 wherein the ammonium salt compound is present in a layer associated with a silver halide emulsion layer.

6. A recording material according to claim 1 wherein the silver halide comprises at least 5% silver chloride.

7. A recording material of claim 1 wherein a co-stabilizing agent is present.

8. A recording material of claim 1 wherein a co-stabilizing agent comprising a sulfur acid or selenium acid or a nitrogen acid is present.

9. A recording material of claim 7 wherein said co-stabilizing agent comprises a mercapto tetrazole.

10. A recording material of claim 1 wherein a co-stabilizing agent is present in a concentratioon of from about 0.05 to about 200 mmoles per mole of silver halide.

11. A recording material according to claim 10 wherein said co-stabilizing agent is present in a concentration of from 0.15 to about 50 mmoles per mole of silver halide.

12. A recording material of claim 7 wherein said co-stabilizing agent comprises 1-(3-acetamidophenyl)-5-mercaptotetrazole.

13. The recording material of claim 7 wherein said co-stabilizing agent comprises 4-hydroxy-6-methyl-2-methylthio-1,3,3A,7-tetraazaindene.

14. The recording material of claim 7 wherein said co-stabilizing agent comprises tolylthiosulfonic acid sodium salt.

* * * * *